US007528801B2

(12) United States Patent
Ito et al.

(10) Patent No.: US 7,528,801 B2
(45) Date of Patent: May 5, 2009

(54) DRIVING METHOD OF PLASMA DISPLAY PANEL AND DRIVING APPARATUS THEREOF, AND PLASMA DISPLAY

(75) Inventors: Kazuhiro Ito, Suwon-si (KR); Tae-Kyoung Kang, Suwon-si (KR); Byung-Gwon Cho, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 486 days.

(21) Appl. No.: 11/104,264

(22) Filed: Apr. 11, 2005

(65) Prior Publication Data

US 2005/0225510 A1 Oct. 13, 2005

(30) Foreign Application Priority Data

Apr. 12, 2004 (KR) ..... 10-2004-0024876

(51) Int. Cl.
*G09G 3/28* (2006.01)

(52) U.S. Cl. ..... 345/60; 315/169.4

(58) Field of Classification Search ..... 345/30, 345/33, 37, 41–42, 55, 60–71, 204–205, 345/208; 315/169.1–169.4
See application file for complete search history.

(56) References Cited

U.S. PATENT DOCUMENTS 4,866,349 A * 9/1989 Weber et al. ..... 315/169.4
6,294,875 B1 9/2001 Kurata et al.
6,686,912 B1 * 2/2004 Kishi et al. ..... 345/211
6,809,708 B2 * 10/2004 Kanazawa et al. ..... 345/68
6,903,515 B2 * 6/2005 Kwak et al. ..... 315/169.4
2002/0097237 A1 * 7/2002 Tomio et al. ..... 345/211
2003/0001512 A1 * 1/2003 Awamoto et al. ..... 315/169.3
2003/0006945 A1 1/2003 Lim et al.
2003/0169216 A1 * 9/2003 Chung et al. ..... 345/60

FOREIGN PATENT DOCUMENTS

KR 2003-0072799 9/2003

OTHER PUBLICATIONS

Korean Patent Abstract for Korean patent application 1020030072799 A, dated Sep. 19, 2003 in the name of LG Electronics Inc.

* cited by examiner

*Primary Examiner*—Richard Hjerpe
*Assistant Examiner*—Jason M Mandeville
(74) *Attorney, Agent, or Firm*—Christie, Parker & Hale, LLP

(57) ABSTRACT

A driving method of a plasma display panel including a discharge space defined by a plurality of scan electrodes, a plurality of sustain electrodes and a plurality of address electrodes for preventing or reducing a misfiring address discharge. In the driving method, a low scan pulse voltage, which is lower than a low scan pulse voltage applied to a previously addressed scan electrode, is applied to a scan electrode which is scanned later in an address period. A low scan pulse voltage applied in an address period of a subfield having a sub-reset period is established to be lower than a low scan pulse voltage applied in an address period of a subfield having a main reset period.

12 Claims, 9 Drawing Sheets

DRIVING METHOD OF PLASMA DISPLAY PANEL AND DRIVING APPARATUS THEREOF, AND PLASMA DISPLAY

CROSS REFERENCE TO RELATED APPLICATION

This application claims priority to and the benefit of Korean Patent Application No. 10-2004-0024876, filed on Apr. 12, 2004 in the Korean Intellectual Property Office, the entire content of which is incorporated herein by reference.

BACKGROUND OF THE INVENTION

1. Field of the Invention

The present invention relates to a driving method of a plasma display panel (PDP) and driving apparatus thereof, and a plasma display.

2. Discussion of the Related Art

Various flat panel displays such as the liquid crystal display (LCD), the field emission display (FED), and the PDP have been developed. Of these, the PDP has higher resolution, a higher rate of emission efficiency, and a wider view angle. Accordingly, the PDP is in the spotlight as a substitute display for the conventional cathode ray tube (CRT), especially in the large-sized displays of greater than forty inches.

A PDP shows characters or images using plasma generated by gas discharge, and it may include more than hundreds of thousands to millions of pixels arranged in a matrix. A PDP can be categorized as a direct current (DC) PDP or an alternating current (AC) PDP according to an applied driving voltage waveform and discharge cell structure of the PDP.

Electrodes of the DC PDP are exposed in a discharge space and the current flows in the discharge space when a voltage is applied, and therefore the DC PDP is problematic in that it requires a resistor for current limitation. On the other hand, electrodes of the AC PDP are covered with a dielectric layer, so the current is limited because of natural formation of capacitance components, and the electrodes are protected from ion impulses in the case of discharging. As such, the AC PDP usually has a longer lifespan than that of the DC PDP.

FIG. 1 shows a partial perspective view of an AC PDP.

As shown in FIG. 1, scan electrodes 4 and sustain electrodes 5 are formed in parallel pairs on a first glass substrate 1, and they are covered with a dielectric layer 2 and a protection film 3. A plurality of address electrodes 8 are formed on a second glass substrate 6, and the address electrodes 8 are covered with an insulator layer 7. Barrier ribs 9 are formed between and in parallel with the address electrodes 8 on the insulator layer 7, and phosphors 10 are formed on the surface of the insulator layer 7 and on both sides of the barrier ribs 9. The first and second glass substrates 1 and 6 are sealed together to form discharge spaces 11 therebetween so that the scan electrodes 4 and the sustain electrodes 5 are orthogonal to the address electrodes 8. A portion of the discharge space 11 at an intersection of an address electrode 8 and a pair of the scan electrode 4 and the sustain electrode 5 forms a discharge cell 12.

FIG. 2 schematically shows a typical electrode arrangement of the AC PDP.

As shown in FIG. 2, the electrodes comprise an m×n matrix. The address electrodes A1 to Am are arranged in the column direction and the scan electrodes Y1 to Yn and the sustain electrodes X1 to Xn are alternately arranged in the row direction. The discharge cell 12 corresponds to the discharge cell 12 in FIG. 1.

FIG. 3 shows driving waveforms of the conventional PDP. The U.S. Patent Application Publication No. US 2003/0006945A1 by Lim et al. discloses a method for driving a conventional plasma display panel shown in FIG. 3. In the method, a scan low voltage Vscl is established to be lower than a voltage Vnf, which is applied last in the reset period.

As shown in FIG. 3, each subfield has a reset period, an address period, and a sustain period. In a rising period of the reset period, a voltage gradually rising to a voltage of Vset is applied to the scan electrodes Y1 to Yn, and therefore a weak discharge is generated in cells. In a falling period of the reset period, a voltage gradually falling to a negative voltage of Vnf is applied to the sustain electrodes while the sustain electrodes X1 to Xn are biased at a predetermined voltage Ve, and therefore wall charges are substantially eliminated. Accordingly, a wall charge state of each cell is reset. In the address period, a pulse voltage Vscl, which is lower than the voltage of Vnf, is sequentially applied to the respective scan electrode lines while the scan electrodes Y1 to Yn are biased at a predetermined voltage Vsch. At this time, an address voltage Va is applied to the address electrodes A1 to An in order to select a discharge. As shown, in the address period, the address voltage Va is reduced by establishing the scan low voltage Vscl sequentially applied to the scan electrodes to be lower than the voltage of Vnf, which is applied last in the reset period. In the sustain period, a discharge for substantially displaying an image in the addressed cell is generated by alternately applying a sustain-discharge voltage Vs to the scan electrodes Y1 to Yn and the sustain electrodes X1 to Xn.

In the conventional driving method as shown in FIG. 3, the wall charges are reduced in the scan electrode lines (e.g., Y0 to Yn lines) which take a relatively long time to be addressed in the wall charge state generated in the reset period, and therefore an address operation may not be properly performed.

FIG. 4 shows driving waveforms of a conventional PDP. U.S. Pat. No. 6,294,875 by Kurata et al. discloses a method for driving the conventional PDP shown in FIG. 4. In this method, a field is divided into eight subfields, and a waveform applied in the reset period of a first subfield is established to be different from waveforms applied in the reset periods of second through eighth subfields.

As shown in FIG. 4, each subfield has a reset period, an address period, and a sustain period. A waveform in the reset period of the first subfield is different from a waveform in the reset period of the second subfield. A gradually rising and falling ramp waveform is applied to the scan electrodes Y1 to Yn in the reset period of the first subfield, and therefore the discharge cells are reset. In the address period, a scan low voltage (GND) is sequentially applied to the scan electrodes, and an address voltage Va is applied to the address electrodes in order to select cells. In the sustain period, a sustain-discharge pulse voltage Vs is alternately applied to the scan electrodes Y1 to Yn and the sustain electrodes X1 to Xn.

A voltage level of a last sustain pulse applied to the scan electrodes Y1 to Yn in the sustain period of the first subfield is substantially the same as that of a voltage of Vr of the reset period, and a voltage of (Vr-Vs) corresponding to a difference between the voltage of Vr and a sustain voltage Vs is applied to the sustain electrodes X1 to Xn. A discharge is generated from the scan electrodes Y1 to Yn to the address electrodes A1 to Am, and the sustain discharge is generated from the scan electrodes Y1 to Yn to the sustain electrodes X1 to Xn in the discharge cell selected in the address period by the wall voltage formed by the address discharge. The discharge corresponds to the discharge generated by a rising ramp voltage in the reset period of the first subfield. No discharge is generated in the discharge cell which is not selected because no address discharge has been generated.

In the reset period of the second subfield, a voltage of Vh is applied to the sustain electrodes X1 to Xn, and a ramp voltage gradually falling from the voltage of Vq to 0V is applied to the scan electrodes Y1 to Yn. That is, a voltage corresponding to the falling ramp voltage applied in the reset period of the first subfield is applied to the scan electrodes Y1 to Yn. A weak discharge is generated in the selected discharge cell and no discharge is generated in the discharge cell which is not selected in the first subfield.

In reset periods of the other subfields, a waveform corresponding to the waveform in the reset period of the second subfield is applied. In an eighth subfield, an erasing period is formed after a sustain period. In the erasing period, a ramp voltage gradually rising from 0V to a voltage of Ve is applied to the sustain electrodes X1 to Xn. The wall charges formed in the discharge cell are eliminated by the ramp voltage.

In the conventional waveform as shown in FIG. 4, an address operation in a subfield having a period for applying a rising and falling ramp voltage as in the first subfield is not performed in the same condition as an address operation in a subfield having a period for applying a falling ramp voltage as in the second subfield. That is, all cells are discharged and reset in the reset waveform of the first subfield. However, in the reset waveform of the second subfield, cells discharged in a previous subfield are reset. Therefore, an address misfiring discharge may be generated because the wall charges and priming particles are reduced when the cells which were not discharged in the previous subfield are addressed in a subfield as in the second subfield.

SUMMARY OF THE INVENTION

In exemplary embodiments of the present invention, a driving method of a plasma display panel for preventing a misfiring discharge in the address period, a driving apparatus thereof, and a plasma display, are provided.

Additional features of the invention will be set forth in the description which follows, and in part will be apparent from the description, or may be learned by practice of the invention.

In an exemplary embodiment according to the present invention, a method for driving a plasma display panel including a discharge space defined by a plurality of first electrodes and a plurality of second electrodes, is provided.

In the method, in an address period, a) a first scan pulse voltage is applied to at least two adjacent electrodes among the plurality of first electrodes, and b) a second scan pulse voltage, which is lower than the first scan pulse voltage, is applied to at least two other adjacent electrodes among the plurality of first electrodes, which are scanned later than the at least two adjacent electrodes.

In another exemplary embodiment according to the present invention, a method for driving a plasma display panel including discharge cells formed by a plurality of first electrodes and a plurality of second electrodes, is provided.

In the method, a) a voltage is applied to a predetermined electrode of the first electrodes and at least one of the second electrodes corresponding to the predetermined electrode so that a first voltage difference can be established in an address period of at least one of subfields including a reset period in which a voltage at the predetermined electrode is increased from a first voltage to a second voltage, wherein the voltage is then reduced, and b) another voltage is applied to the predetermined electrode of the first electrodes and at least one of the second electrodes corresponding to the predetermined electrode so that a second voltage difference which is greater than the first voltage difference can be established in an address period of at least another one of the subfields including a reset period in which the voltage at the predetermined electrode is reduced from a third voltage to a fourth voltage to discharge at least one of the discharge cells which was discharged in a sustain period of a previous one of the subfields. Also, in the address period of the at least one of the subfields, a voltage may be applied to an $I^{th}$ electrode of the first electrodes and at least one of the second electrodes corresponding to the $I^{th}$ electrode so that the first voltage difference can be established, and a voltage may be applied to a $J^{th}$ electrode of the first electrodes, which is scanned later than the $I^{th}$ electrode, and at least one of the second electrodes corresponding to the $J^{th}$ electrode so that a third voltage difference which is greater than the first voltage difference can be established.

In yet another exemplary embodiment according to the present invention, a method for driving a plasma display panel including a discharge space defined by a plurality of first electrodes and a plurality of second electrodes, is provided. In an address period of at least one of a plurality of subfields forming a field, a first scan voltage is applied to at least one of the plurality of first electrodes, and a second scan pulse voltage, which is lower than the first scan pulse voltage, is applied to at least another one of the plurality of first electrodes, which is scanned later than the at least one of the first electrodes. In an address period of at least another one of the plurality of subfields forming the field, the first scan voltage is applied to the at least one of the plurality of first electrodes, and the second scan pulse voltage is applied to at least another one of the plurality of first electrodes, which is scanned later than the at least one of the first electrodes.

In yet another exemplary embodiment according to the present invention, an apparatus for driving a plasma display panel including a plurality of first electrodes, a plurality of second electrodes, a plurality of third electrodes, and a panel capacitor formed between the first, second, and third electrodes, is provided.

The apparatus includes a first switch and a second switch respectively having a first terminal coupled to a first terminal of the panel capacitor. The apparatus also includes a capacitor having a first terminal and a second terminal coupled between a second terminal of the first switch and a second terminal of the second switch and for charging a voltage of a first power source. In addition, the apparatus includes a third switch coupled between the second terminal of the capacitor and a second power source, and at least one zener diode coupled between the second terminal of the capacitor and the second power source. The apparatus may further include a fourth switch coupled between the second terminal of the capacitor and the at least one zener diode.

In yet another exemplary embodiment according to the present invention, a plasma display including a first substrate, a plurality of first electrodes and a plurality of second electrodes arranged on the first substrate in parallel, a second substrate facing the first substrate with a gap therebetween, and a driving circuit for supplying a driving voltage to the first, second, and third electrodes to discharge discharge cells formed by the first, second, and third electrodes, is provided.

The driving circuit applies a first scan pulse voltage to a predetermined electrode among the first electrodes in an address period of at least one of subfields having a reset period in which a voltage at the predetermined electrode is increased from a first voltage to a second voltage, wherein the voltage is then reduced. The driving circuit also applies a second scan pulse voltage, which is lower than the first scan pulse voltage, to the predetermined electrode among the first electrodes in an address period of at least another one of the subfields having a reset period in which the voltage at the predetermined electrode is gradually reduced from a third voltage to a fourth voltage to discharge at least one of the discharge cells, which was discharged in a sustain period of a previous one of the subfields.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
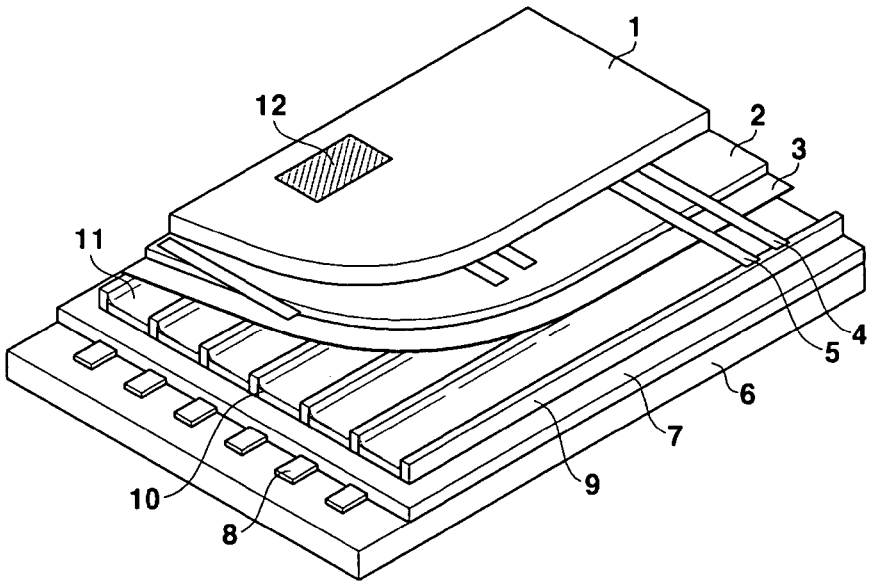
FIG.1 (Prior Art)
FIG. 1 shows a partial perspective view of an alternating circuit (AC) plasma display panel (PDP).
Figure 2:
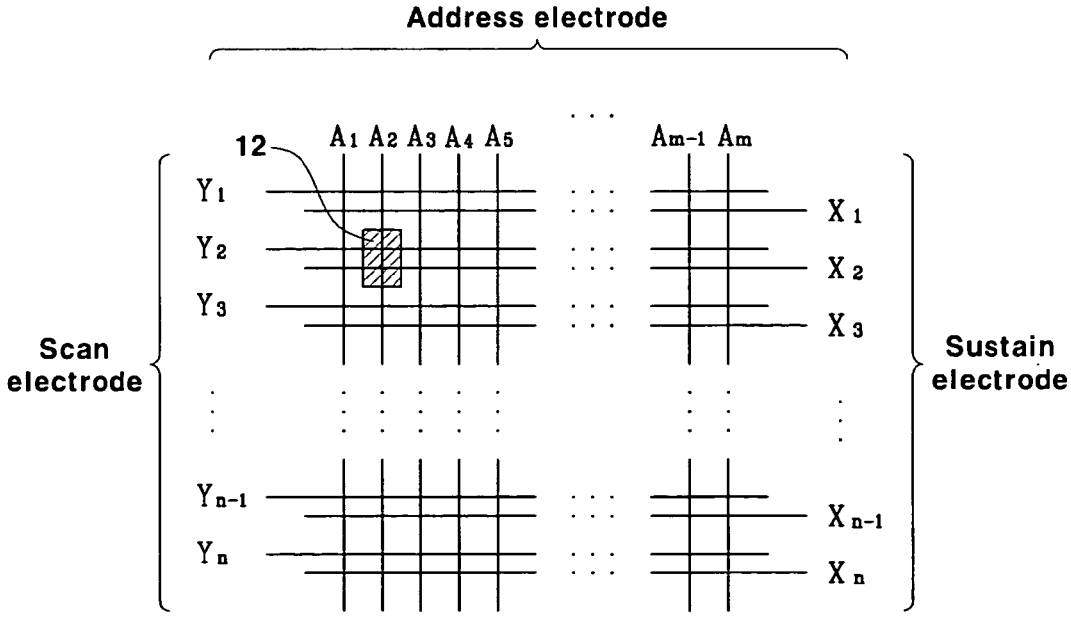
FIG.2 (Prior Art)
FIG. 2 shows an electrode arrangement of the PDP

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Like reference numerals designate like elements.

Exemplary embodiments of the present invention will now be described in detail with reference to the drawings.

Waveforms applied to address electrodes A1 to Am, sustain electrodes X1 to Xn, and scan electrodes Y1 to Yn will be described with reference to FIG. 5 and FIG. 6. They will be described based on a discharge cell formed by an address electrode, a sustain electrode, and a scan electrode.

Figure 5:
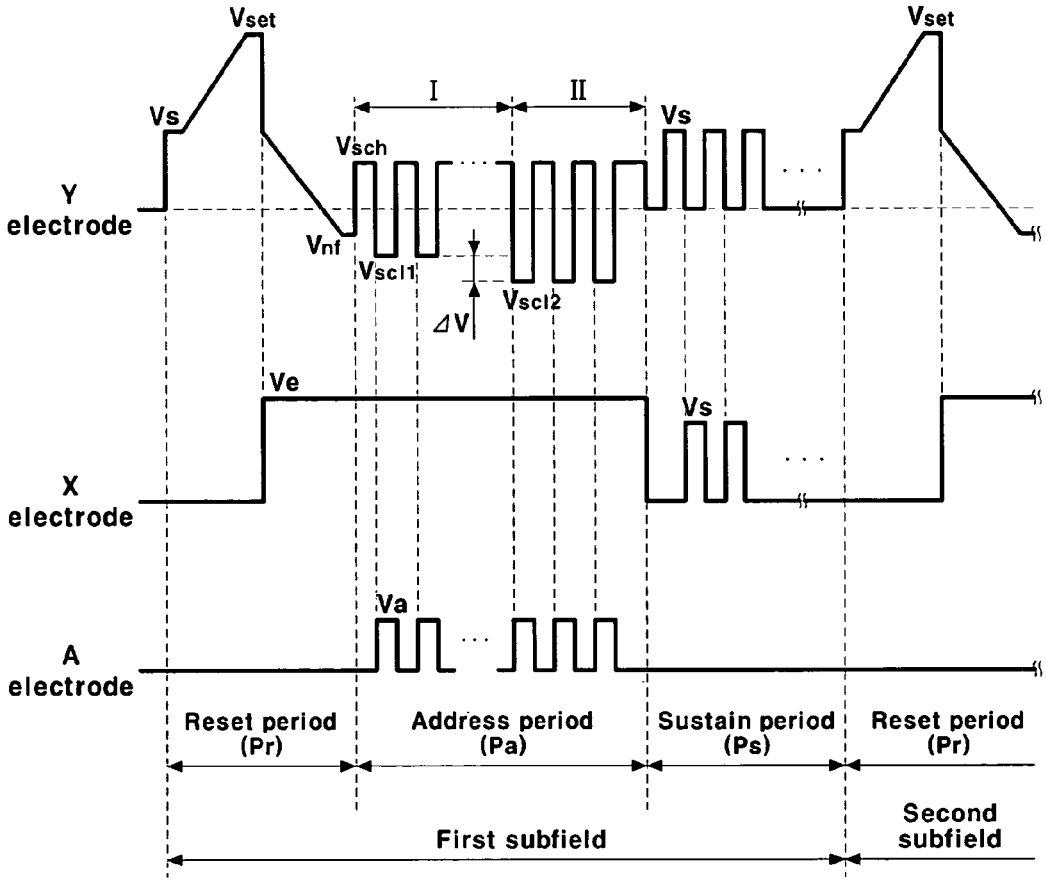
FIG. 5 shows driving waveforms of a PDP according to a first exemplary embodiment of the present invention.
Figure 6:
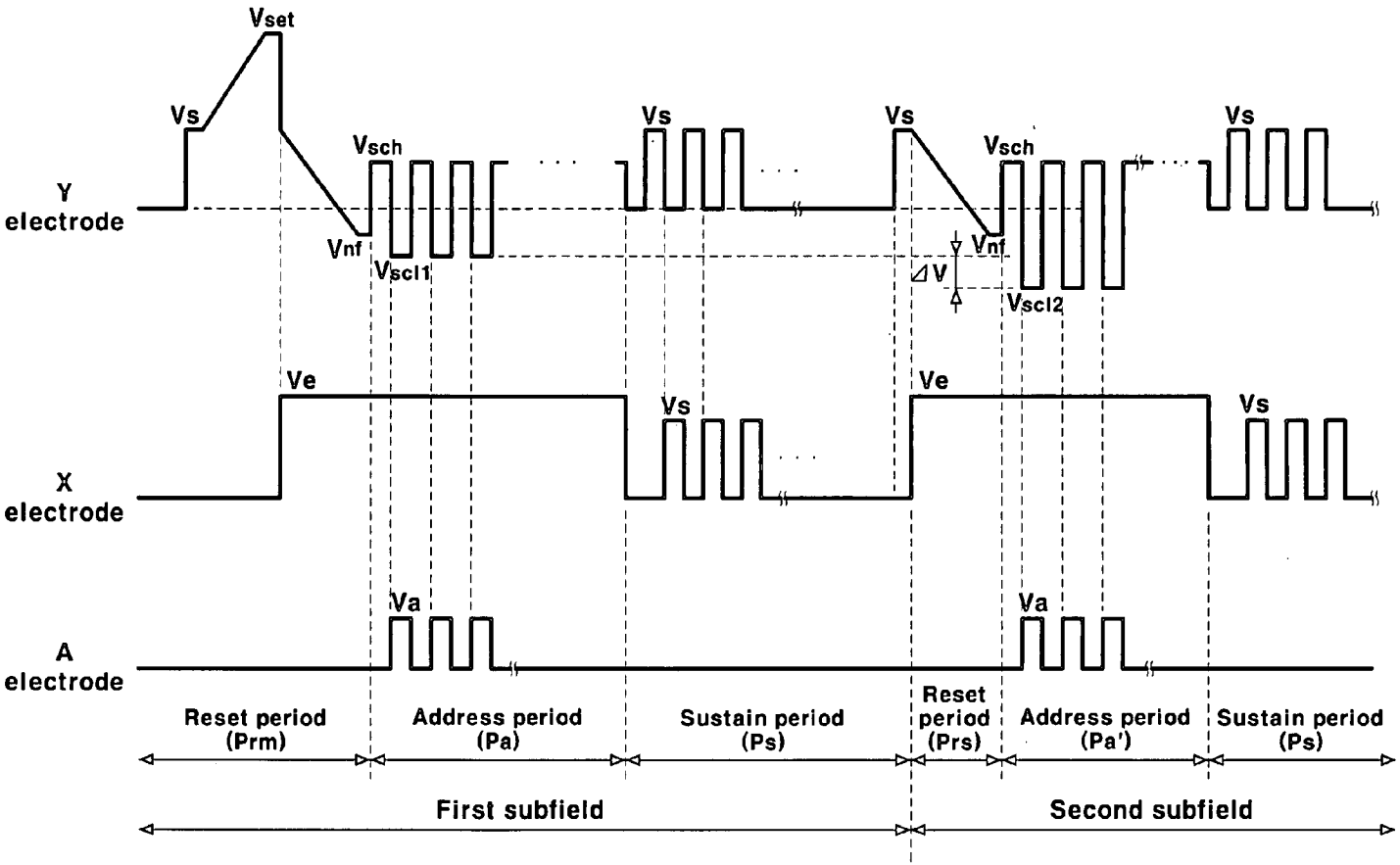
FIG. 6 shows driving waveforms of a PDP according to a second exemplary embodiment of the present invention.

FIG. 5 shows driving waveforms of a plasma display panel according to a first exemplary embodiment of the present invention, and FIG. 6 shows driving waveforms of a plasma display panel according to a second exemplary embodiment of the present invention. While only two subfields, namely, first and second subfields, are illustrated in FIGS. 5 and 6, a field can be divided into more than two subfields (e.g., eight or twelve subfields) in the first and second exemplary embodiments of the present invention. Further, the waveforms applied to the X, Y and A electrodes in those additional subfields can be substantially the same as the waveforms of the first and/or second subfields.

As shown in FIG. 5 and FIG. 6, the driving waveforms according to the first and the second exemplary embodiments of the present invention have a reset period, an address period, and a sustain period. In a plasma display, a scan/sustain driving circuit (illustrated in FIG. 9) for applying driving voltages to the scan electrodes Y1 to Yn (hereinafter, referred to as "Y electrodes") and the sustain electrodes X1 to Xn (hereinafter, referred to as "X electrodes"), and an address driving circuit (illustrated in FIG. 9) for applying a driving voltage to the address electrodes A1 to An (hereinafter, referred to as "A electrodes"), are coupled to the plasma display panel. The driving circuits and the plasma display panel are coupled to each other to thus form the plasma display. The respective waveforms, or any suitable portion or portions thereof, in the exemplary embodiments of FIGS. 5 and 6, respectively, can be applied to the X electrodes, Y electrodes and the A electrodes.

Figure 3:
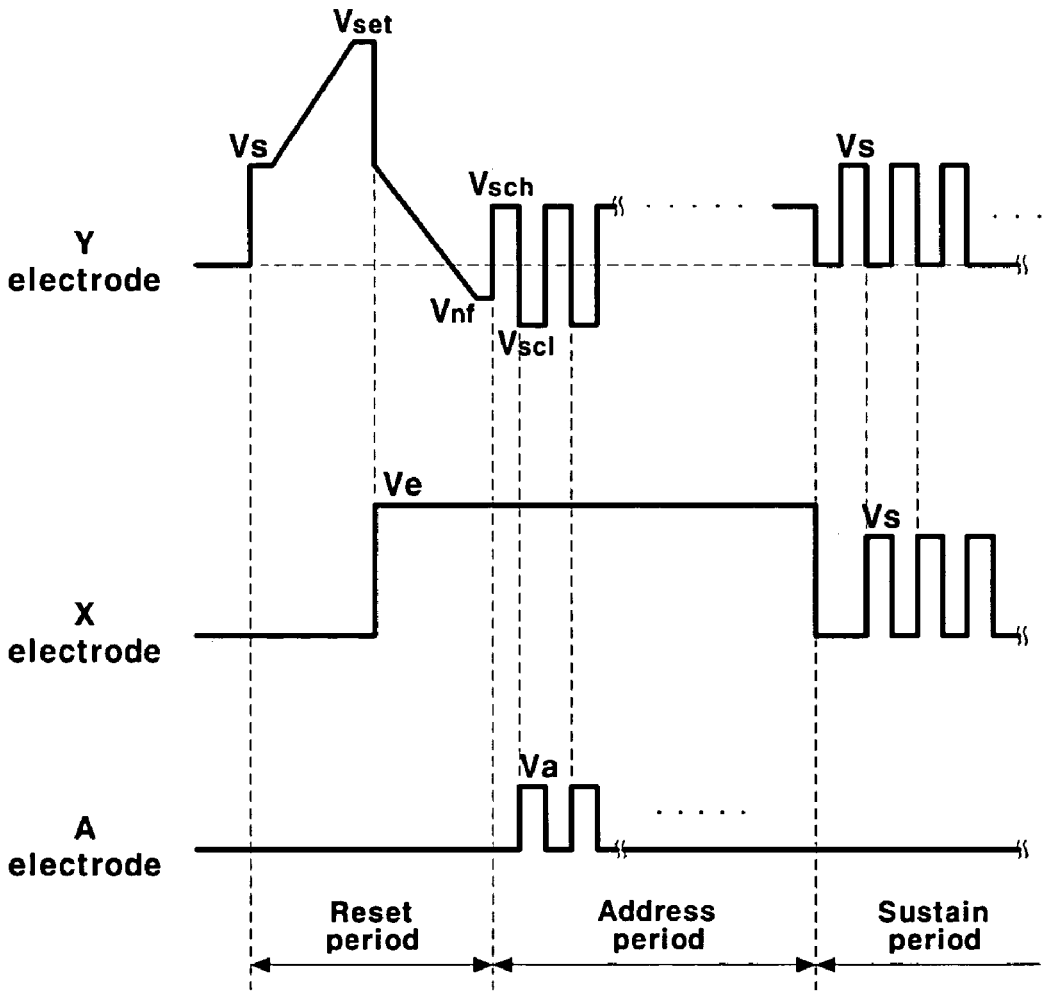
FIG.3 (Prior Art)
FIG. 3 shows driving waveforms of a conventional PDP.

As shown in FIG. 5, while the driving waveforms of the plasma display panel according to the first exemplary embodiment of the present invention are similar to the conventional driving waveforms shown in FIG. 3, scan pulse voltages Vscl1 and Vscl2 applied in an address period are different from the scan pulse voltages of the conventional driving waveforms.

A voltage gradually rising to a voltage of Vset is applied to the Y electrode in a reset period. Weak discharges are generated in discharge cells from the Y electrode to the X electrode and the A electrode, and therefore negative (−) wall charges are formed on the Y electrode. A ramp voltage gradually falling to a voltage of Vnf (negative voltage) is applied to the Y electrode while the X electrode is biased at a voltage of Ve. At this time, the weak discharges are generated from the X electrode and the A electrode to the Y electrode, and the wall charges formed on the X electrode, Y electrode, and the A electrode are substantially eliminated for a proper address operation.

The address period Pa is divided into two parts I and II, and a low scan pulse voltage sequentially applied to the Y electrode in a first period I is different from the low scan pulse voltage sequentially applied to the Y electrode in a second period II. That is, the low scan pulse voltage applied to the Y electrode in the second period II has a voltage level lower than that in the first period I.

As shown in FIG. 5, a low scan pulse voltage Vscl1 is sequentially applied to the Y electrodes Y1, Y2 . . . and Yn while the Y electrodes are biased at a predetermined voltage of Vsch in the first period I of the address period. At this time, an address voltage of Va is applied to the A electrode in order to select cells (i.e., discharge cells). Accordingly, an address operation is performed using a lower address voltage of Va by applying a voltage which is lower than the voltage of Vnf, which is applied last in a falling period of the reset period, as the low scan voltage Vscl1.

In the second period II of the address period, a voltage of Vscl2, which is lower than the low scan voltage Vscl1 sequentially applied to the Y electrode in the first period I, is applied as the low scan voltage. That is, a voltage difference between the low scan voltages applied in the first period I and the second period II is established to be ΔV. In the second period II, however, the address voltage of Va applied to the A electrode is substantially the same as that in the first period.

The first period I is an address period of a line which was previously addressed, and the second period II is an address period of a line which is later addressed in the address period. That is, the low scan voltage Vscl2 applied to the Y electrode of a cell which is later addressed is lower than the low scan voltage Vscl1 applied to the Y electrode of a cell which was previously addressed. Accordingly, a problem, that the wall charges (or priming particles) are further reduced in the cell which is later addressed after the reset period, is solved by the application of the low scan voltage Vscl2, which is lower than the low scan voltage Vscl1. That is, a problem that the address discharge is not generated because of the wall charge (or priming particle) loss is solved by applying the low scan voltage Vscl2 at a voltage level which is lower than that of the low scan voltage Vscl1 (the low scan voltage Vscl2 is applied to the Y electrode line in which the wall charges are further reduced because it is later scanned, and the low scan voltage Vscl1 is applied to the Y electrode line, which has previously been scanned).

In the sustain period, the selected cell in the address period is sustain-discharged by alternately applying a sustain-discharge pulse voltage Vs to the Y electrode and the X electrode. Driving waveforms that are substantially the same as those in the first subfield are applied in a second subfield.

While two different voltages Vscl1 and Vscl2 are applied as the low scan voltages Vscl in the first exemplary embodiment of the present invention, a plurality of low scan voltages having different voltage levels can be applied and therefore an even lower low scan voltage can be applied to the cell which is later addressed, and this can cause the same or similar effect.

As shown in FIG. 6, in driving waveforms according to a second exemplary embodiment of the present invention, a low scan pulse voltage Vscl1 applied to the Y electrode in a subfield having a reset period Prm (hereinafter, referred to as a "main reset period") for generating reset discharges in discharge cells is established to be different from a low scan pulse voltage Vscl2 applied to the Y electrode in a subfield having a reset period Prs (hereinafter, referred to as a "sub-reset period") for generating a reset discharge in a cell which was sustain-discharged in a previous subfield.

In the reset period Prm of a first subfield, wall charges are properly established for the address operation by applying the rising waveform and the falling waveform to the Y electrode in a manner similar to that of the reset period of the first exemplary embodiment of the present invention. In FIG. 6, the reset period Prm of the first subfield is a main reset period, and the wall charges are properly formed for the address operation by generating the reset discharges in the discharge cells.

In the address period, the low scan voltage Vscl1 is sequentially applied to the Y electrode while the Y electrode is biased at a predetermined voltage Vsch. At this time, an address discharge is properly generated by applying a voltage which is lower than the voltage of Vnf, which is applied last in the main reset period Prm, as the low scan voltage Vscl1. Accordingly, the address voltage Va applied to the A electrode is reduced.

In the sustain period, a sustain discharge is generated by alternately applying a sustain discharge pulse voltage Vs to the Y electrode and the X electrode.

At this time, a last sustain pulse voltage level applied to the Y electrode in the sustain period of the first subfield corresponds to the voltage of Vs, and a ground voltage 0V is applied to the X electrode. In the discharge cell selected in the address period Pa, a discharge is generated from the Y electrode to the A electrode by the wall voltage formed by the address discharge, and a sustain-discharge is generated from the Y electrode to the X electrode. The discharge corresponds to the discharge generated by the rising ramp voltage in the reset period Prm of the first subfield. No discharge is generated in the cell which is not selected because the address discharge has not been generated.

Figure 4:
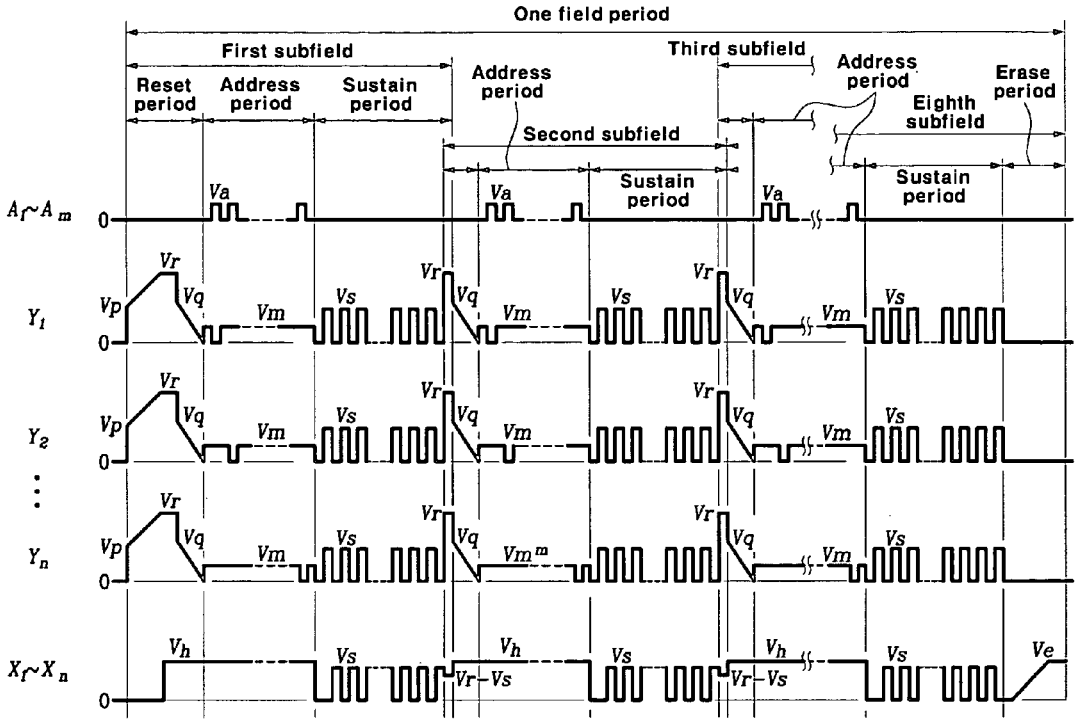
FIG.4 (Prior Art)
FIG. 4 shows driving waveforms of a conventional PDP.

A ramp voltage gradually falling from the voltage of Vs to the voltage of Vnf (negative voltage) is applied to the Y electrode while the voltage of Ve is applied to the X electrode in the reset period Prs of the second subfield. That is, a voltage corresponding to the falling ramp voltage applied in the reset period of the first subfield is applied to the Y electrode. A weak discharge is generated in the discharge cell selected in the first subfield, and no discharge is generated in the discharge cell which is not selected. The reset period Prs of the second subfield substantially corresponds to the conventional waveform shown in FIG. 4.

In an address period Pa' of the second subfield, the low scan voltage Vscl2 is sequentially applied to the Y electrode line while the predetermined voltage of Vsch is applied to the Y electrode. At this time, the low scan voltage Vscl2 applied to the Y electrode in the address period of the second subfield is lower than the low scan voltage Vscl1 applied to the Y electrode in the address period of the first subfield. The address voltage Va applied to the A electrode in the second subfield corresponds to the address voltage Va applied to the A electrode in the first subfield. That is, a difference between the low scan voltage Vscl2 applied to the Y electrode in the second subfield and the low scan voltage Vscl1 applied to the Y electrode in the first subfield is established to be $\Delta V$.

As shown, the low scan voltage Vscl2, which is applied in the address period of a subfield (second subfield) having the sub-reset period Prs for generating the reset discharge in the cell which was discharged in the sustain period of a previous subfield, has a voltage level lower than that of the low scan voltage Vscl1, which is applied in the address period of a subfield (first subfield) having the main reset period. Accordingly, the wall charge loss is compensated because the reset discharge is not generated in the second subfield when the cell which is not selected in the first subfield is selected in the second subfield. That is, a misfiring discharge in the address period caused by the loss of the wall charges (or priming particles) is prevented by applying a voltage, which is lower than Vscl1, as the low scan voltage Vscl2 applied in the subfield having the sub-reset period Prs.

A sustain-discharge is generated by alternately applying a sustain-discharge pulse voltage Vs to the Y electrode and the X electrode in the sustain period of the second subfield.

While voltages that are substantially the same as the low scan pulse voltage Vscl1 applied in the first subfield are applied to the scan lines (Y electrode lines) in the second exemplary embodiment of the present invention, a voltage which is lower than the low scan pulse voltage Vscl1 is applied to scan lines which are scanned later in a manner similar to that of the first exemplary embodiment of the present invention for the purpose of reducing or eliminating the misfiring discharge caused by the wall charge loss. While voltages that are substantially the same as the low scan pulse voltage Vscl2 applied in the second subfield are applied to the scan lines (Y electrode lines) in the second exemplary embodiment of the present invention, a voltage which is lower than the low scan pulse voltage Vscl2 can also be applied to the scan lines which are scanned later, and therefore the misfiring discharge caused by the wall charge loss can be substantially eliminated.

A driver of the plasma display panel for applying low scan pulse voltages Vscl1 and Vscl2 in the first and the second exemplary embodiments of the present invention will be described. That is, a driver of the plasma display panel for generating two low scan pulse voltages having two different voltage levels using a single power source will be described.

Figure 7:
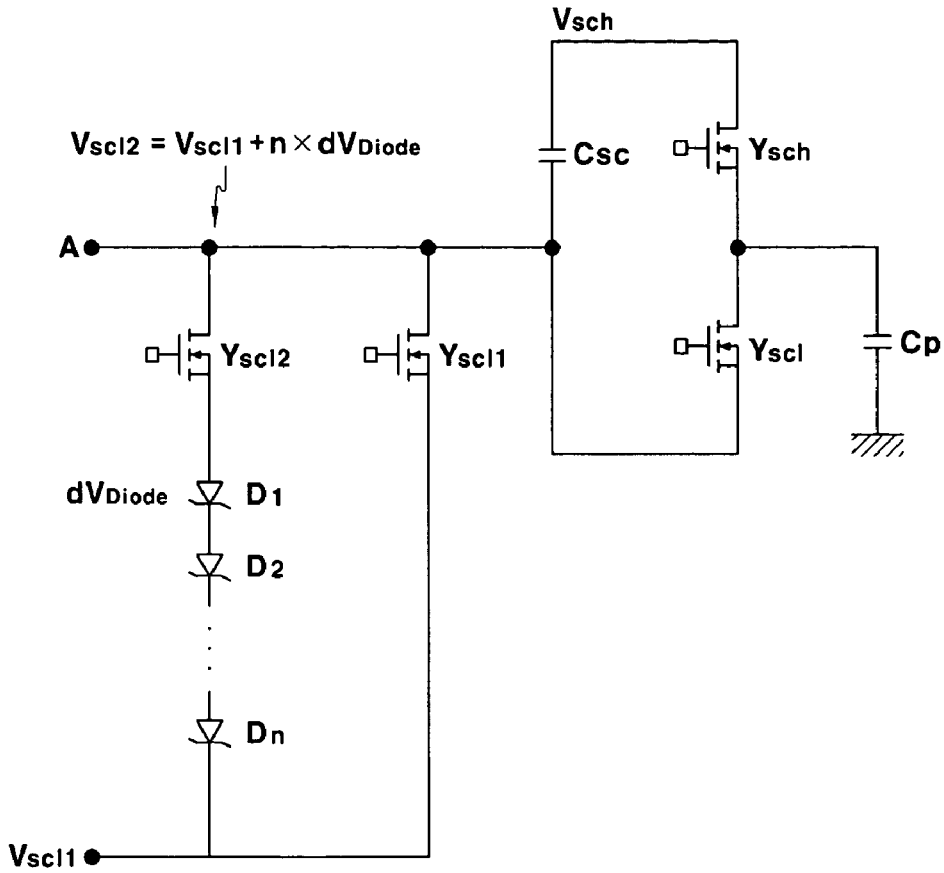
FIG. 7 shows a diagram for representing a driver of the PDP according to one exemplary embodiment of the present invention.
Figure 8:
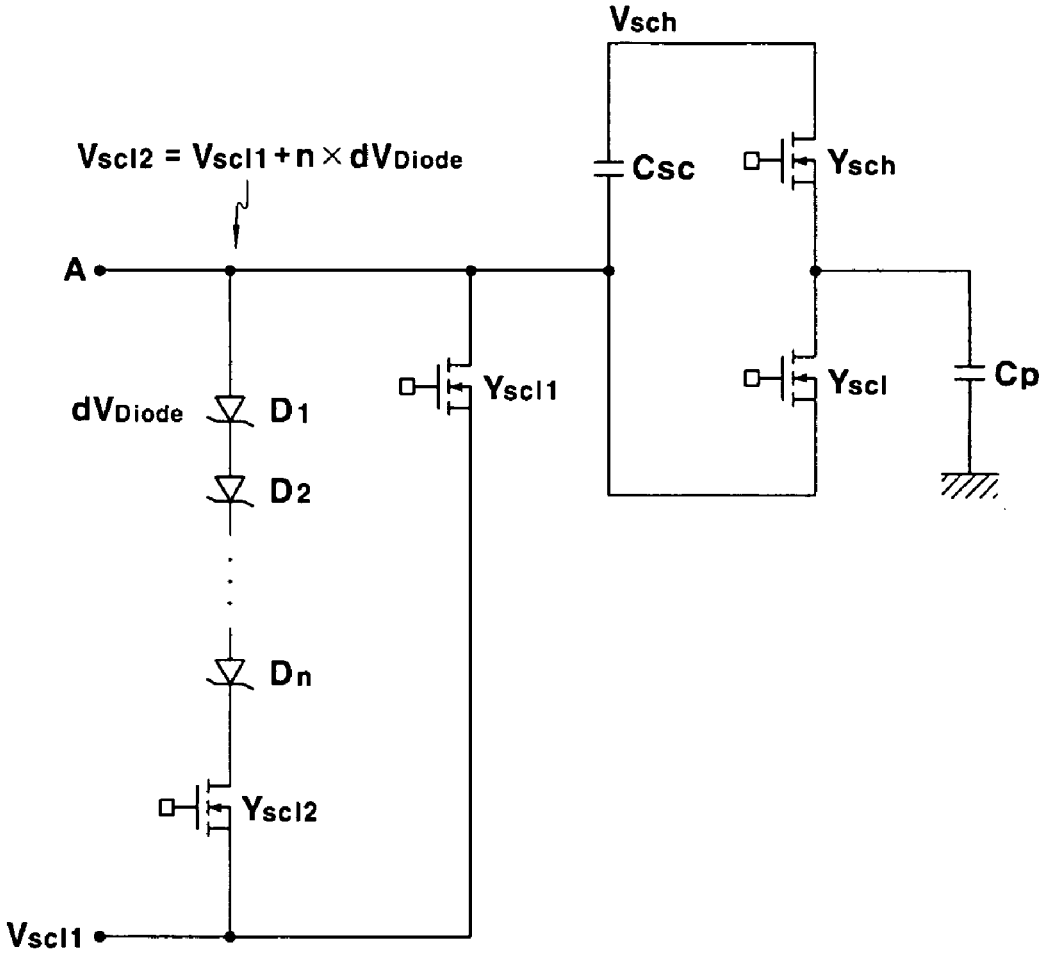
FIG. 8 shows a diagram for representing a driver of the PDP according to one exemplary embodiment of the present invention.

FIG. 7 and FIG. 8 show a part of the driver for applying the low scan voltages Vscl1 and Vscl2 in the address period. A circuit for realizing waveforms applied in the reset period and the sustain period is coupled to A in each of FIG. 7 and FIG. 8. However, such a circuit for realizing waveforms of the reset and sustain periods will not be described as they are not essential to the complete understanding of the invention. Either the driver of FIG. 7 or the driver of FIG. 8 can be used for applying the low scan voltages Vscl1 and Vscl2 of FIGS. 5 and 6.

As shown in FIG. 7, the driver of the plasma display panel according to one exemplary embodiment of the present invention includes a panel capacitor Cp which is equivalent with a discharge cell as a capacitor, two switches Ysch and Yscl for respectively switching a high scan voltage Vsch and a low scan voltage Vscl at a first terminal of the panel capacitor Cp, a capacitor Csc for biasing the high scan voltage at a Y electrode (that is, the first terminal of the panel capacitor) in an address period, and two switches Yscl1 and Yscl2 for respectively switching two low scan voltages Vscl1 and Vscl2. The driver further includes a plurality of zener diodes D1, D2 . . . Dn for forming a voltage of Vscl2 by using a voltage of Vscl1. The first terminal of the panel capacitor Cp is a part corresponding to the Y electrode, and a second terminal of the panel capacitor Cp is a part corresponding to other electrodes (X electrode and A electrode). It will be assumed that the second terminal of the panel capacitor Cp is coupled to a ground.

The first terminal of the panel capacitor is coupled to first terminals of the switches Ysch and Yscl in parallel, and the capacitor Csc is coupled between second terminals of the switches Ysch and Yscl. Here, the capacitor Csc is charged with the high scan voltage Vsch in the address period. The switches Yscl1 and Yscl2 are coupled in parallel between a power source of Vscl1 and a node between the capacitor Csc and the switch Yscl. The zener diodes D1, D2 . . . Dn are coupled in series between the switch Yscl2 and the power source of Vscl1.

A method for applying the low scan voltages Vscl1 and Vscl2 to the Y electrode (the first terminal of the panel capacitor) in the driver of the plasma display panel shown in FIG. 7 will be described.

The capacitor Csc is charged with the voltage of Vsch in the address period. Accordingly, the high scan voltage Vsch is applied to the first terminal of the panel capacitor (Y electrode) when the switch Ysch is turned on.

The switches Yscl and Yscl1 are turned on in order to apply the low scan pulse voltage Vscl1. The low scan pulse voltage Vscl1 is applied to the first terminal of the panel capacitor (Y electrode).

The switches Yscl and Yscl2 are turned on in order to apply the low scan pulse voltage Vscl2. At this time, a voltage of ($Vscl1+n*dV_{Diode}$) is applied to the first terminal of the panel capacitor (Y electrode) when a voltage which is greater than a breakdown voltage $dV_{Diode}$ is applied to the zener diodes D1, D2 . . . Dn. As described, the low scan pulse voltage Vscl2 is formed by using the breakdown voltage $dV_{Diode}$ of the zener diode and the power of Vscl1. The zener diodes D1, D2 . . . Dn having a proper breakdown voltage $dV_{Diode}$ are selected so that ($Vscl2=Vscl1+n*dV_{Diode}$) can be established.

FIG. 8 shows a diagram for representing a driver of the plasma display panel according to one exemplary embodiment of the present invention. The driver is substantially the same as the driver of FIG. 7 except that the places where the switch Yscl2 and the zener diodes D1, D2 . . . Dn are provided are changed with each other. A method for generating the low scan pulse voltages Vscl1 and Vscl2 in the exemplary embodiment of FIG. 8 is substantially the same as the method according to the exemplary embodiment of FIG. 7, and therefore descriptions will be omitted.

The low scan voltages Vscl1 and Vscl2 are realized by using one power source of Vscl1 in the driver of the plasma display panel according to the first and the second exemplary embodiments of the present invention, and the low scan voltages Vscl1 and Vscl2 are applied by proper switching operations of the switches Ysch, Yscl, Yscl1, and Yscl2 in the like manner shown in FIG. 5 and FIG. 6.

Figure 9:
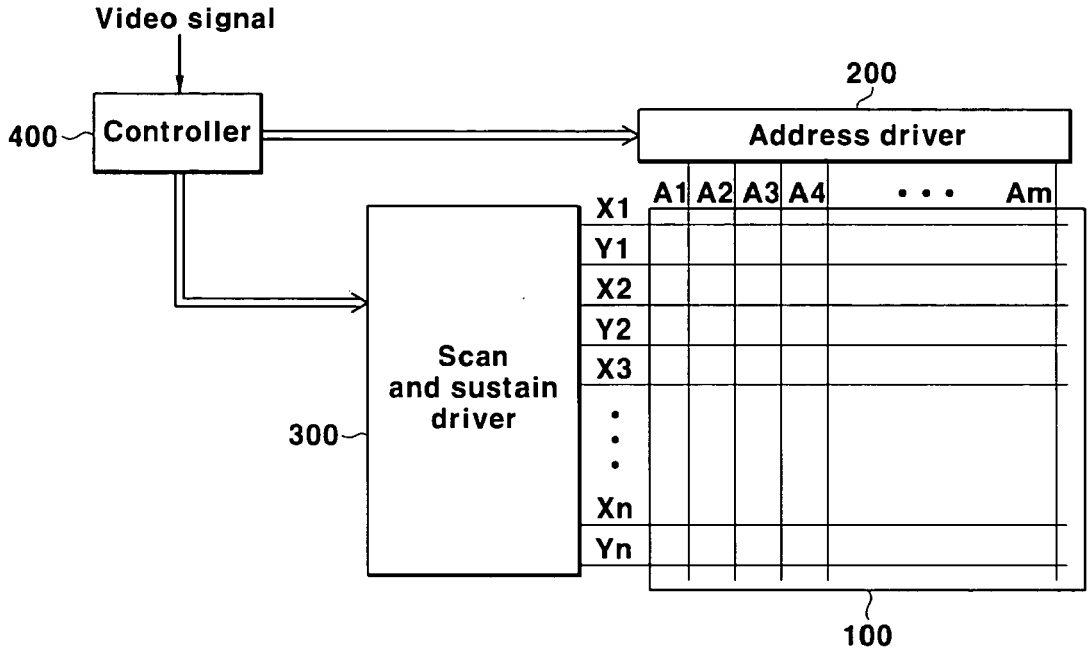
FIG. 9 is a schematic block diagram of a plasma display that can be used to implement exemplary embodiments of the present invention.

A plasma display of FIG. 9 includes a plasma display panel 100, an address driver 200, a scan/sustain driver 300, and a controller 400. The plasma display panel 100 includes address electrodes A1 to Am, sustain electrodes X1 to Xn and scan electrodes Y1 to Yn. The plasma display panel 100 may, for example, have substantially the same configuration as the plasma display panel of FIG. 1. The address driver 200 and the scan/sustain driver 300 can be referred to together as a driving circuit. The controller 400 receives a video signal and provides corresponding control signals to the address driver 200 and the scan/sustain driver 300. The address driver 200 and the scan/sustain driver 300 supply a driving voltage to the address electrodes, the sustain electrodes and the scan electrodes, respectively, to discharge discharge cells formed by the address electrodes, sustain electrodes and the scan electrodes. The scan/sustain driver 300, for example, can include the low scan voltage driver part of FIG. 7 and/or the low scan voltage driver part of FIG. 8.

Figure 10:
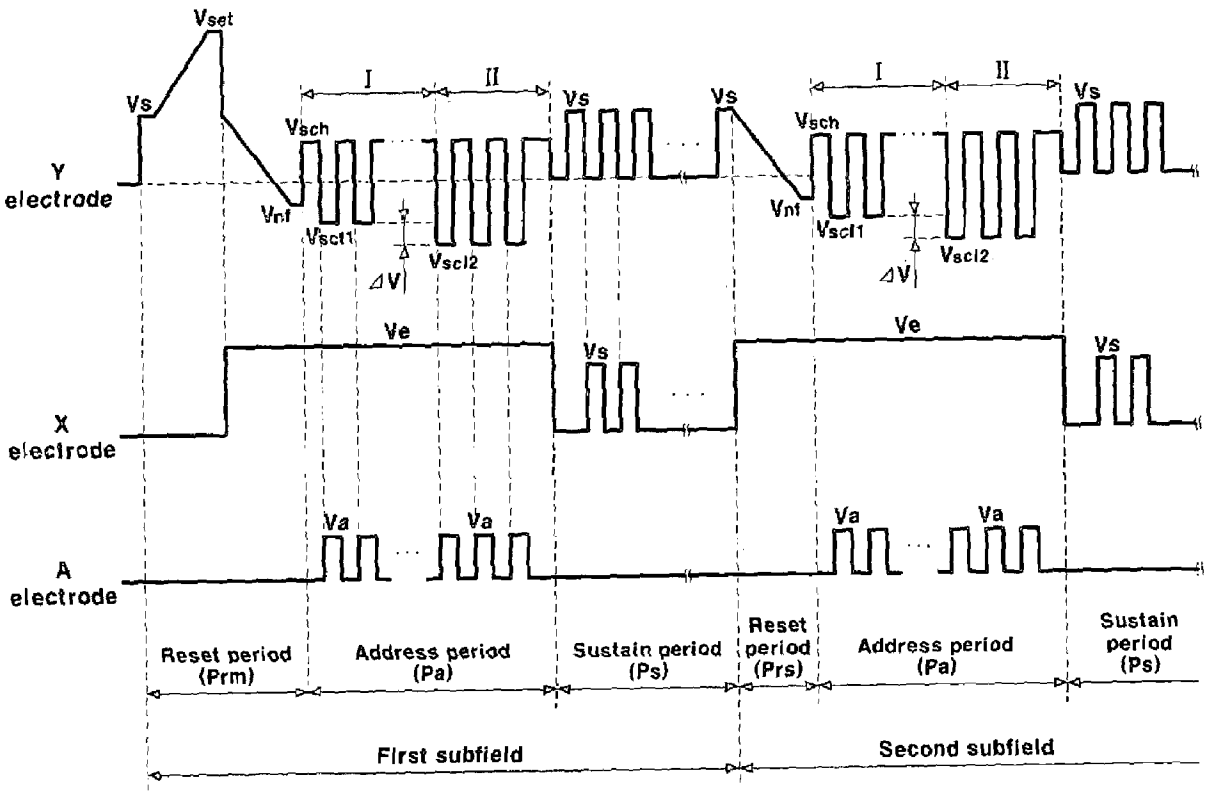
FIG. 10 driving waveforms of a PDP according to a third exemplary embodiment of the present invention.

Since waveforms during a reset period (Prm), an address period (Pa) and a sustain period (Ps) in a first subfield of FIG. 10 according to a third exemplary embodiment are substantially the same as the waveforms during the reset period (Pr), the address period (Pa) and the sustain period (Ps) in the first subfield of FIG. 5, the waveforms in the first subfield of FIG. 10 will not be discussed in detail herein. In a second subfield of FIG. 10, waveforms during an address period (Pa) and a sustain period (Ps) are substantially the same as the waveforms during the corresponding periods of the first subfield. However, a waveform during a reset period (Prs) of the second subfield in FIG. 10 is different from the waveform during the reset period (Prm) of the first subfield. The waveform during the reset period (Prs) of the second subfield in FIG. 10 is substantially the same as the waveform during the reset period Prs of the second subfield in FIG. 6.

It can be seen in FIG. 10 that each of the first and second subfields has an address period that is divided into two periods, namely, a first period I and a second period II. A low scan pulse voltage Vscl1 sequentially applied to the Y electrode in the first period I is different from the low scan pulse voltage Vscl2 sequentially applied to the Y electrode in the second period II. In more detail, the low scan pulse voltage Vscl2 applied to the Y electrode in the second period II has a voltage level lower than the low scan pulse voltage Vscl1 in the first period I.

The misfiring discharge caused by the wall charge loss can be reduced or prevented by a second low scan pulse voltage, which is lower than a first low pulse scan voltage, applied in the address period in the cell where the wall charges (or priming particles) are damaged.

While this invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

What is claimed is:

1. A method for driving a plasma display panel comprising a plurality of discharge cells corresponding to a plurality of first electrodes and a plurality of second electrodes, and a driving circuit comprising a first switch having a first terminal electrically coupled to a power supply for supplying a first scan pulse voltage and a second terminal electrically coupled to the first electrodes, and a series combination of a second switch and at least one Zener diode electrically coupled in parallel with the first switch between the first terminal and the second terminal of the first switch, the plasma display panel configured to be driven during a plurality of subfields, each subfield comprising a reset period, an address period, and a sustain period, the method comprising:

in the address period, a) turning on the first switch to apply the first scan pulse voltage to at least two adjacent electrodes among the plurality of first electrodes; and b) turning on the second switch to apply a second scan pulse voltage, which is lower than the first scan pulse voltage, to at least two other adjacent electrodes among the plurality of first electrodes, which are scanned later than the at least two adjacent electrodes.

2. The method of claim 1, wherein the first scan pulse voltage is lower than a voltage which is applied last to the first electrodes in a reset period.

3. The method of claim 1, wherein the plurality of first electrodes are configured to receive the first scan pulse voltage and the second scan pulse voltage, and the first scan pulse voltage and the second scan pulse voltage are respectively applied to the plurality of first electrodes in sequence.

4. The method of claim 1, wherein in a) and b), a third voltage which is greater than the first scan pulse voltage is applied to at least one of the second electrodes while the first and the second scan pulse voltages are applied.

5. A method for driving a plasma display panel comprising a plurality of discharge cells corresponding to a plurality of first electrodes and a plurality of second electrodes, and a driving circuit comprising a first switch having a first terminal electrically coupled to a power supply for supplying a first scan pulse voltage and a second terminal electrically coupled to the first electrodes, and a series combination of a second switch and at least one Zener diode electrically coupled in parallel with the first switch between the first terminal and the second terminal of the first switch, the plasma display panel configured to be driven during a plurality of subfields, the method comprising:

a) turning on the first switch to apply a first scan pulse voltage to at least one electrode of the first electrodes, and applying a voltage that is different from the first scan pulse voltage to at least one of the second electrodes corresponding to the at least one electrode of the first electrodes so that a first voltage difference can be established in an address period of at least one of the subfields comprising a reset period in which a voltage at the at least one electrode of the first electrodes is increased from a first voltage to a second voltage, wherein the voltage is then reduced; and b) turning on the second switch to apply a second scan pulse voltage to the at least one electrode of the first electrodes, and applying a voltage that is different from the second scan pulse voltage to at least one of the second electrodes corresponding to the at least one electrode of the first electrodes so that a second voltage difference which is greater than the first voltage difference can be established in an address period of at least another one of the subfields comprising a reset period in which the voltage at the at least one electrode of the first electrodes is reduced from a third voltage to a fourth voltage to discharge at least one of the discharge cells which was discharged in a sustain period of a previous one of the subfields.

6. The method of claim 5, wherein substantially the same voltages are applied to the at least one of the second electrodes in a) and b), and the second scan pulse voltage which is applied to the at least one electrode of the first electrode in b) is lower than the first scan pulse voltage applied to the at least one electrode of the first electrodes in a).

7. The method of claim 6, wherein the first scan pulse voltage is sequentially applied to the first electrodes in a), and the second scan pulse voltage is sequentially applied to the first electrodes in b).

8. The method of claim 5, further comprising, in the address period of the at least one of the subfields, applying a voltage to an $I^{th}$ electrode of the first electrodes and at least one of the second electrodes corresponding to the $I^{th}$ electrode so that the first voltage difference can be established; and applying a voltage to a $J^{th}$ electrode of the first electrodes, which is scanned later than the $I^{th}$ electrode, and at least one of the second electrodes corresponding to the $J^{th}$ electrode so that a third voltage difference which is greater than the first voltage difference can be established.

9. A method for driving a plasma display panel comprising a plurality of discharge cells corresponding to a plurality of first electrodes and a plurality of second electrodes, and a driving circuit comprising a first switch having a first terminal electrically coupled to a power supply for supplying a first scan pulse voltage and a second terminal electrically coupled to the first electrodes, and a series combination of a second switch and at least one Zener diode electrically coupled in parallel with the first switch between the first terminal and the second terminal of the first switch, the plasma display panel configured to be driven during a plurality of subfields, each subfield comprising a reset period, an address period, and a scan period, the method comprising:

in the address period of at least one of the subfields, a) turning on the first switch to apply the first scan pulse voltage to at least one of the plurality of first electrodes; and b) turning on the second switch to apply a second scan pulse voltage, which is lower than the first scan pulse voltage, to at least another one of the plurality of first electrodes, which is scanned later than the at least one of the first electrodes; and in an address period of at least another one of the subfields, c) applying the first scan pulse voltage to the at least one of the plurality of first electrodes; and d) applying the second scan pulse voltage to the at least another one of the plurality of first electrodes, which is scanned later than the at least one of the first electrodes.

10. The method of claim 9, wherein a reset waveform applied during a reset period of the at least one of the plurality of subfields is different from a reset waveform applied during a reset period of the at least another one of the plurality of subfields.

11. A plasma display including:

a first substrate;

a plurality of first electrodes and a plurality of second electrodes arranged on the first substrate in parallel;

a second substrate facing the first substrate with a gap therebetween;

a plurality of third electrodes formed on the second substrate and crossing the first and the second electrodes; and a driving circuit for supplying a driving voltage to the first, second, and third electrodes, the driving circuit comprising a first switch having a first terminal electrically coupled to a power supply for supplying a first scan pulse voltage and a second terminal electrically coupled to the first electrodes, and a series combination of a second switch and at least one Zener diode electrically coupled in parallel with the first switch between the first terminal and the second terminal of the first switch, wherein the driving circuit is configured to apply the first scan pulse voltage when the first switch is turned on to at least one electrode among the first electrodes in an address period of at least one of subfields having a reset period in which a voltage at the at least one electrode among the first electrodes is increased from a first voltage to a second voltage, wherein the voltage is then reduced, and the driving circuit applies a second scan pulse voltage, which is lower than the first scan pulse voltage, when the second switch is turned on, to the at least one electrode among the first electrodes in an address period of at least another one of the subfields having a reset period in which the voltage at the at least one electrode among the first electrodes is gradually reduced from a third voltage to a fourth voltage to discharge at least one of the discharge cells, which was discharged in a sustain period of a previous one of the subfields.

12. The plasma display of claim 11, wherein the driving circuit applies a third scan pulse voltage, which is lower than the first scan pulse voltage, to at least one of the first electrodes which is scanned later than the at least one electrode among the first electrodes to which the first scan pulse voltage is applied in the address period of the at least one of the subfields, and applies a fourth scan pulse voltage which is lower than the second scan pulse voltage to a second one of the first electrodes which is scanned later than the at least one electrode among the first electrodes to which the second scan pulse voltage is applied in the address period of the at least another one of the subfields.

* * * * *

UNITED STATES PATENT AND TRADEMARK OFFICE

CERTIFICATE OF CORRECTION

PATENT NO. : 7,528,801 B2
APPLICATION NO. : 11/104264
DATED : May 5, 2009
INVENTOR(S) : Kazuhiro Ito et al.

It is certified that error appears in the above-identified patent and that said Letters Patent is hereby corrected as shown below:

In the Claims

| | |
|---|---|
| Column 11, line 26, Claim 2 | Delete "in a reset",<br>Insert --in the reset-- |
| Column 12, line 9, Claim 6 | Delete "electrode", second occurrence<br>Insert --electrodes-- |

Signed and Sealed this

Twenty-third Day of February, 2010

David J. Kappos

David J. Kappos
*Director of the United States Patent and Trademark Office*